US011332914B2

(12) United States Patent
Armbruster et al.

(10) Patent No.: US 11,332,914 B2
(45) Date of Patent: May 17, 2022

(54) WASHSTAND ARRANGEMENT HAVING A FOUNTAIN JET WATER DISCHARGE DEVICE

(71) Applicant: Hansgrohe SE, Schiltach (DE)

(72) Inventors: Stefan Armbruster, Hausach (DE); Marcel Bilger, Rottweil (DE); Axel Meißner, Offenburg (DE)

(73) Assignee: Hansgrohe SE, Schiltach (DE)

( * ) Notice: Subject to any disclaimer, the term of this patent is extended or adjusted under 35 U.S.C. 154(b) by 144 days.

(21) Appl. No.: 16/812,242

(22) Filed: Mar. 6, 2020

(65) Prior Publication Data

US 2020/0284003 A1 Sep. 10, 2020

(30) Foreign Application Priority Data

Mar. 8, 2019 (DE) ..... 10 2019 203 164.1

(51) Int. Cl.
*E03C 1/048* (2006.01)
*B05B 1/18* (2006.01)
(Continued)

(52) U.S. Cl.
CPC ..... *E03C 1/048* (2013.01); *B05B 1/185* (2013.01); *E03C 1/0404* (2013.01); *E03C 1/18* (2013.01)

(58) Field of Classification Search
CPC ..... E03C 1/048; E03C 1/0404; E03C 1/18; B05B 1/185
(Continued)

(56) References Cited

U.S. PATENT DOCUMENTS 1,756,290 A * 4/1930 Hibner ..... E03C 1/264 4/289
1,805,560 A * 5/1931 Barta ..... D06F 1/08 4/651
(Continued)

FOREIGN PATENT DOCUMENTS

CN 201261898 Y 6/2009
CN 202767183 U 3/2013
(Continued)

OTHER PUBLICATIONS

Office Action in German Language issued by the German Patent Office, Munich, Germany, dated Feb. 7, 2020, for German Patent Application No. 10 2019 203 164.1.
(Continued)

*Primary Examiner* — Huyen D Le
(74) *Attorney, Agent, or Firm* — Bose McKinney & Evans LLP

(57) ABSTRACT

A washstand arrangement with a fountain jet water discharge device. More particularly, a washstand device includes a washstand having a wash-bowl sink and a water discharge device, configured for discharging water in the form of a fountain jet composed of individual jets and comprising a plurality of water discharge nozzles which are arranged in the wash-bowl sink for discharging the individual jets in associated individual jet directions from the wash-bowl sink obliquely upwards and back again to the wash-bowl sink. The water discharge nozzles are arranged within a strip-type nozzle assignment region having a strip length extending in sink circumferential direction and a strip height perpendicular thereto, wherein its strip length is greater than its strip height, and its strip length extends at most across half the sink circumference.

16 Claims, 4 Drawing Sheets

(51) Int. Cl.
*E03C 1/04* (2006.01)
*E03C 1/18* (2006.01)

(58) Field of Classification Search
USPC ..... 4/675
See application file for complete search history.

(56) References Cited

U.S. PATENT DOCUMENTS

| | | | | |
|---|---|---|---|---|
| 2,775,774 | A * | 1/1957 | Logan | A47C 1/08 4/620 |
| 2,999,248 | A * | 9/1961 | Logan | A61H 35/02 4/620 |
| 4,231,123 | A * | 11/1980 | Cheng | E03C 1/23 4/519 |
| 7,000,266 | B2 | 2/2006 | Piatt et al. | |
| 7,155,759 | B2 | 1/2007 | Milne | |
| 7,461,419 | B2 | 12/2008 | Milne | |
| 9,228,330 | B1 | 1/2016 | Brown et al. | |
| 10,132,063 | B2 | 11/2018 | Nagayanagi et al. | |
| 2004/0194208 | A1 | 10/2004 | Milne | |
| 2007/0061960 | A1 | 3/2007 | Sha et al. | |
| 2012/0124737 | A1 | 5/2012 | Gibson | |
| 2018/0100297 | A1 | 4/2018 | Boland | |
| 2018/0178225 | A1 | 6/2018 | Butzke et al. | |

FOREIGN PATENT DOCUMENTS

| | | | |
|---|---|---|---|
| CN | 106413492 | A | 2/2017 |
| DE | 202004019664 | U1 | 5/2005 |
| DE | 102016225987 | A1 | 6/2018 |
| EP | 2108749 | A2 | 10/2009 |
| JP | 2001292920 | A | 10/2001 |
| RU | 2350247 | C2 | 3/2009 |
| RU | 2697239 | C1 | 8/2019 |
| WO | 2007086734 | A1 | 8/2007 |
| WO | 2012033350 | A2 | 3/2012 |

OTHER PUBLICATIONS

Search Report issued by the European Patent Office, Munich Germany, dated Jul. 31, 2020, for European Patent Application No. 20161132.4, 7 pages.

Office Action issued by the Federal Institute of Industrial Property (FIIP), Russia, dated Sep. 17, 2020, for Russian Patent Application No. 20201096755/12(016130)(partial English language translation included), 10 pages.

Office Action issued by the National Intellectual Property Administration, P.R. China, dated Jan. 25, 2021 for Chinese Patent Application No. 202010152483.2 (In Chinese language with English translation), 16 pages.

* cited by examiner

WASHSTAND ARRANGEMENT HAVING A FOUNTAIN JET WATER DISCHARGE DEVICE

CROSS-REFERENCE TO RELATED APPLICATION

This application claims priority to German Patent Application No. DE 10 2019 203 164.1, filed on Mar. 8, 2019, the disclosure of which is expressly incorporated herein by reference.

BACKGROUND AND SUMMARY OF THE DISCLOSURE

The invention relates to a washstand arrangement which comprises a washstand having a wash-bowl sink and a water discharge device which is configured for discharging water in the form of a fountain jet composed of individual jets and which has a plurality of water discharge nozzles which are arranged in the wash-bowl sink for discharging the individual jets in associated individual jet directions issued from the wash-bowl sink obliquely upwards and back again to the wash-bowl sink.

The washstand arrangement may, for example, act as a washing place in a bathroom, or the like, at which the user can wash or perform various other body care actions. Whilst washstand arrangements in most cases have a sanitary outlet fitting having an outlet pipe which terminates over the wash-bowl sink as the only water discharge device, in the present washstand arrangement the water discharge device is configured to discharge the specific fountain jet.

A washstand arrangement of the type mentioned in the introduction is disclosed in the patent publications U.S. Pat. No. 7,155,759 B2 and U.S. Pat. No. 7,461,419 B2. In the washstand arrangement therein, the water discharge nozzles are formed by means of water discharge openings in the wash-bowl sink which are arranged in a preferably irregular pattern over the entire sink or in any case in an upper region of the sink over the entire circumference of the sink. The water discharge nozzles are all orientated with their associated individual jet directions towards a central region over the wash-bowl sink so that an arched fountain jet is produced. When the arrangement of the water discharge nozzles is limited to the upper sink region, in a lower portion of the sink the pattern of the water discharge openings located above can be continued by means of discharge openings of the same shape which act as a water drain. Alternatively, the wash-bowl sink has a conventional central water drain.

It is an object of the invention to provide a washstand arrangement of the type mentioned in the introduction whose water discharge device enables the discharge of water in the form of an alternative fountain jet compared with the prior art explained above whose jet pattern affords significant advantages in terms of application.

The illustrative embodiment of the invention achieves this and other objects by providing a washstand arrangement which includes a washstand having a wash-bowl sink and a water discharge device which is configured for discharging water in the form of a fountain jet composed of individual jets and which has a plurality of water discharge nozzles which are arranged in the wash-bowl sink for discharging the individual jets in associated individual jet directions issued from the wash-bowl sink obliquely upwards and back again to the wash-bowl sink. The water discharge nozzles are arranged within a strip-like nozzle assignment region having a strip length extending in the sink circumferential direction and a strip height perpendicular thereto. In this instance, the strip length of the nozzle assignment region is greater than its strip height and the nozzle assignment region extends with its strip length at most across half the sink circumference.

With this specific water discharge device, the washstand arrangement according to the invention enables the discharge of water in the form of a fountain jet which is advantageous for many applications. As a result of this specific nozzle assignment region, it is possible to provide the fountain jet in terms of its shape and in particular its jet form in a similar manner to, for example, a cascade jet which has a jet cross-section perpendicular to the jet expansion direction and which has a horizontal jet width which is larger, preferably several times larger, than a vertical jet width, that is to say, jet height. The fountain jet may provide a water flow which is more localised over the jet path thereof in comparison with the mentioned conventional arched fountain jet and which leaves larger regions over the wash-bowl sink free so that the user does not become unnecessarily or undesirably wet as long as he acts in these regions and in the region occupied with water there is a water flow which is relatively dense over the path of the fountain jet and which the user can effectively use for his application. This fountain jet differs from a conventional cascade jet and from other conventional water discharge jets using outlet fittings with an outlet pipe which terminates over the sink as a result of the trajectory thereof which is directed in the manner of a trajectory parabola obliquely upwards and then obliquely downwards and the composition thereof comprising a plurality of individual jets discharged by the water discharge nozzles.

All of this affords the user significant advantages for many different applications. Thus, the fountain jet is inter alia suitable for washing one's hands, washing one's face, cleaning teeth, filling cups or the like with water, rinsing containers, cleaning objects, etc. As a result of its combined trajectory parabolic shape and fan-like shape, it is further also particularly suitable for washing hair, or washing the head and cleaning beards. As a result of the omission of a water outlet pipe over the wash-bowl sink, the user has unimpeded space to place his head over the sink for these applications.

For water discharge nozzles, any conventional embodiments can be used. The nozzles may be produced purely as outlet openings in the wash-bowl sink or as independent nozzle elements, for example, in the form of corresponding jet outlet nipples which are placed in corresponding nozzle receiving openings of the sink. Advantageously, there can be used in particular specific fine/mist jet nozzles, as used in shower devices marketed by the Applicant under the trademark PowderRain and as also disclosed in the Patent Application DE 10 2016 225 987 A1 of the Applicant, or other conventional fine jet nozzles or needle jet nozzles, alternatively also general conventional normal jet nozzles, as commonly installed in shower heads.

In an illustrative development of the invention, the nozzle assignment region extends with the strip length thereof across at most one quarter of the sink circumference. This further contributes to a desirably good localisation of the water discharged from the water discharge device within the correspondingly localised fountain jet comprising the bundle of individual jets. In advantageous embodiments, the nozzle assignment region extends with the strip length thereof over at least a fifth and a maximum of a quarter of the sink circumference.

In an illustrative development of the invention, the water discharge nozzles in the nozzle assignment region are arranged in at least two nozzle rows, wherein the water discharge nozzles of a respective nozzle row are arranged in the sink circumferential direction offset in relation to the water discharge nozzles of an adjacent nozzle row. It can be seen that this specific arrangement of the water discharge nozzles contributes to a greater extent to an optimum jet pattern of the fountain jet for most washing applications.

In an illustrative development of the invention, the nozzle assignment region is located in a rear-side half of the wash-bowl sink facing away from the user side. The term rear-side half facing away from the user side is intended in this instance to be understood to be the half of the wash-bowl sink opposite the front-side half of the wash-bowl sink, wherein the front side refers to the side of the wash-bowl sink at which the user approaches or stands in front of the wash-bowl sink when using the washstand arrangement correctly, whilst at the opposite rear side of the wash-bowl sink or the washstand, a mirror or a mirrored cabinet is often arranged. The water discharge device thereby directs the fountain jet in the direction towards the user, whether it be from the rear in a forward direction directly onto him or alternatively in a direction obliquely from the rear or laterally from the rear in a forward direction or laterally in a forward direction. This positioning of the nozzle assignment region has generally been found to be particularly advantageous for most typical washing applications.

In an illustrative embodiment of the invention, the wash-bowl sink has a water drain in the front-side half facing the user side, wherein a fountain jet impingement zone, that is to say, the region in which the fountain jet strikes the wash-bowl sink, is located at a side of the water drain facing the nozzle assignment region. This position of the water drain relative to the nozzle assignment region and to the fountain jet impingement zone has been found to be advantageous for achieving a desired optimum water discharge.

In another illustrative embodiment of the invention, the water drain is formed in a slot-like manner having a slot longitudinal axis which is perpendicular to a lateral fountain jet main directional component. This slot form of the water drain is advantageously adapted to the shape of the fountain jet and further contributes to an optimised discharge of the water reaching the wash-bowl sink via the fountain jet.

In an illustrative development of the invention, the water discharge nozzles are arranged in at least two successive nozzle groups in the sink circumferential direction, with a plurality of water discharge nozzles in each case. In this instance, a maximum difference of jet outlet directions of the water discharge nozzles of a respective nozzle group is less than a minimum difference of the jet outlet directions of the water discharge nozzles of two adjacent nozzle groups. In other words, the individual jets of the nozzles within each nozzle group extend in directions which are the same or which differ from each other to a comparatively small extent, whilst the individual jet directions of the water discharge nozzles of two adjacent nozzle groups differ from each other to a greater extent. It has been found that, with this measure, a particularly advantageous jet pattern for the fountain jet can be achieved, as is optimal for many applications.

In an illustrative embodiment of the invention, the water discharge nozzles are arranged specifically in three successive nozzle groups in the sink circumferential direction, wherein the water discharge nozzles of a respective nozzle group have the same lateral jet outlet directional components and the lateral jet outlet directional components of two lateral nozzle groups extend in a manner inclined with respect to the lateral jet outlet directional component of a central nozzle group by the same oblique angle value. This produces a fountain jet with a very advantageous symmetrical jet pattern. The term lateral jet outlet directional component is intended to refer in this instance to the directional component of the jet outlet directions of the individual jets determined by the nozzles, which is produced for the lateral, that is to say, horizontal, projection of the jet outlet direction perpendicular to the vertical height direction.

In an illustrative development of the invention, the washstand arrangement contains a water distributor body on a bottom side of the wash-bowl sink in the nozzle assignment region. The water distributor body comprises a water supply chamber extending over the length of the nozzle assignment region and a water distribution chamber which is separated from the water supply chamber by a partition wall and which is connected in fluid communication to the water supply chamber via a plurality of passage openings in the partition wall. The water discharge nozzles are coupled to the water distributor body, wherein the water discharge nozzles are in fluid communication with the water distribution chamber via lateral inlet openings. This provides an advantageous implementation for the water supply to the water discharge nozzles which are arranged in the wash-bowl sink. As a result of the separation into the water supply chamber and the water distribution chamber which is in fluid communication therewith via the passage openings, the water can be supplied in a comparatively uniform manner and consequently also with the same pressure relationships to the various water discharge nozzles. The water discharge nozzles are thereby again readily able to discharge identical individual jets, that is to say, individual jets with substantially the same trajectory height and trajectory width of their parabolic shape.

Additional features and advantages of the present invention will become apparent to those skilled in the art upon consideration of the following detailed description of the illustrative embodiments best exemplifying the best mode of carrying out the invention as presently perceived.

BRIEF DESCRIPTION OF THE DRAWINGS

Advantageous exemplary embodiments of the invention are illustrated in the drawings. These and other advantageous embodiments of the invention will be described below. In the drawings.

DETAILED DESCRIPTION OF THE DRAWINGS

Figure 1:
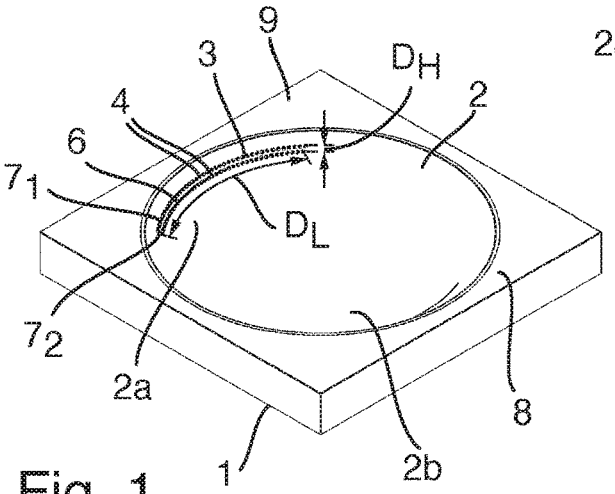
FIG. 1 is a perspective view of a washstand arrangement viewed obliquely from the top front.

The embodiments of the invention described herein are not intended to be exhaustive or to limit the invention to precise forms disclosed. Rather, the embodiments selected for description have been chosen to enable one skilled in the art to practice the invention.

The washstand arrangement illustrated in the Figures comprises a washstand 1 having a wash-bowl sink 2 and a water discharge device 3 which is configured to discharge water in the form of a fountain jet comprising individual jets and which has a plurality of water discharge nozzles 4. The water discharge nozzles 4 are arranged in the wash-bowl sink 2 for discharging the individual jets in associated individual jet directions issued from the wash-bowl sink 2 obliquely upwards and back again into the wash-bowl sink 2. FIGS. 6 to 10 show the washstand arrangement with an activated water discharge device 3 which then discharges supplied water as a fountain jet 5 which is composed of individual jets 11 which are discharged from the water discharge nozzles 4.

Figure 2:
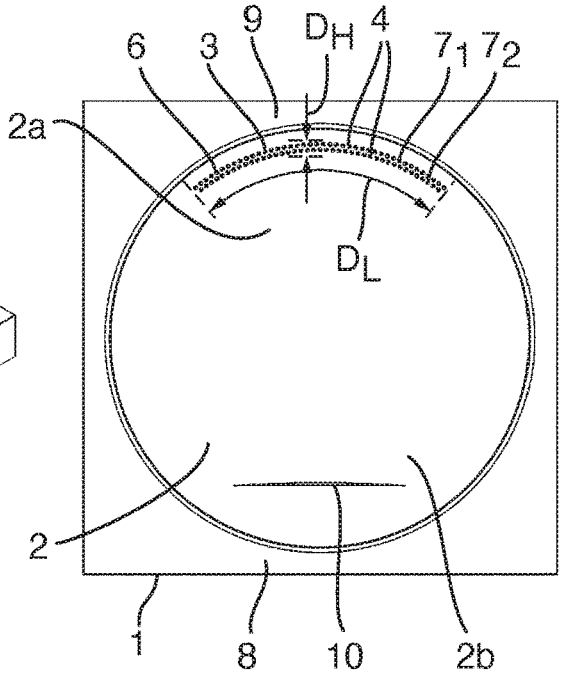
FIG. 2 is a plan view of the washstand arrangement of FIG. 1.

The water discharge nozzles 4 are arranged within a strip-type nozzle assignment region 6 having a strip length $D_L$ extending in the sink circumferential direction and a strip height $D_H$ perpendicular thereto, wherein the strip length $D_L$ thereof is greater than the strip height thereof and it extends with its strip length at most across half the sink circumference. The strip length $D_L$ which in a normal position for use of the washstand arrangement extends in a horizontal plane, in accordance with the shape of the sink 2, for example, with a curved path, and the strip height $D_H$ which is perpendicular thereto are illustrated by way of example in FIGS. 1 and 2.

In advantageous embodiments, the nozzle assignment region 6 extends as in the example shown with the strip length $D_L$ thereof over a maximum of one quarter of the sink circumference, for example, over a length which is between a fifth and a quarter of the sink circumference. The strip height $D_H$ is in advantageous embodiments many times smaller than the strip length $D_L$, for example, smaller by at least a factor of 5 or at least a factor of 10 or at least a factor of 15 or at least a factor of 20 or at least a factor of 25.

In advantageous embodiments, the wash-bowl sink 2 is circular as in the example shown. In alternative embodiments, it has a different shape, for example, oval or rectangular or any other, for example, irregular shape.

In advantageous embodiments, as in the exemplary embodiment shown, the water discharge nozzles 4 are arranged in the nozzle assignment region 6 in at least two nozzle rows 71, 72, wherein the water discharge nozzles 4 of a respective nozzle row 71, 72 are arranged in the sink circumferential direction so as to be offset with respect to the water discharge nozzles 4 of a respective adjacent nozzle row 71, 72.

In advantageous embodiments, as in the example shown, the water discharge nozzles 4 of adjacent nozzle rows 71, 72 are arranged in a centrally offset manner, that is to say, each nozzle 4 of one nozzle row is located when viewed in a sink circumferential direction centrally between two mutually adjacent nozzles 4 of the other nozzle row. In other words, the nozzles 4 are arranged in the adjacent nozzle rows 71, 72 to be offset relative to each other by half the nozzle spacing of the nozzles 4 within the respective nozzle row 71, 72. In alternative embodiments, an eccentric offset is selected.

In the exemplary embodiment shown, the nozzle assignment region 6 contains precisely two nozzle rows 71, 72. In alternative embodiments, it contains more than two nozzle rows, for example, between three and eight nozzle rows.

In advantageous embodiments, as in the example shown, the nozzle assignment region 6 is located in a rear-side half 2*a* of the wash-bowl sink 2 facing away from the user side. This rear-side half 2*a* is opposite a front-side half 2*b* of the wash-bowl sink 2 facing the user side. The front-side half 2*b* of the sink 2 facing the user side as a whole faces a front side 8 of the sink 2 and the washstand 1 which, when the washstand arrangement is used in the intended manner, forms the user side, that is to say, the side which the user approaches when he wishes to use the washstand arrangement. A rear side 9 of the sink 2 and the washstand 1 at which in typical washstand arrangements, for example, a mirror or a mirrored cabinet is located, which is of no further interest in this instance and is therefore not shown, is opposite this front side 8. In alternative embodiments, the nozzle assignment region 6 is also located at least partially in the front-side half 2*b* of the wash-bowl sink 2 facing the user side, that is to say, with a corresponding portion closer to the front side 8 than the rear side 9 of the sink 2 or the washstand 1.

In advantageous embodiments, the wash-bowl sink 2 has, as in the example shown, in the front-side half 2*b* facing the user side a water drain 10. As can be seen, for example, in FIG. 10, a fountain jet impingement zone $F_A$ of the wash-bowl sink 2 is located at a side of the water drain 10 facing the nozzle assignment region 6. The fountain jet impingement zone is intended to refer in this instance to the region $F_A$ of the sink 2 within which the fountain jet 5 strikes the sink surface when it is not used by the user and is not thereby interrupted by him. Preferably, the fountain impingement zone $F_A$ is located, as in the example shown, in the direct vicinity or in any case with only little spacing of a maximum of a few centimetres to or from the water drain 10. This property and the positioning of the water drain 10 offset with respect to the sink centre in the direction towards the front side 8 optimises, together with the rear positioning of the water discharge device 3, the shape and use of the fountain jet 5 and the water discharge from the sink 2. In alternative embodiments, the water drain is located in a conventional manner in a central region of the wash-bowl sink 2 or offset to the rear with respect thereto, and/or the fountain jet impingement zone $F_A$ is located at the side of the water drain 10 facing away from the nozzle assignment region 3.

In an advantageous embodiment, the water drain 10 is formed, as in the embodiment shown, in a slot-like manner with a slot longitudinal axis $L_S$ which is perpendicular relative to a lateral fountain jet main directional component $F_H$. The term lateral fountain jet main directional component is in this instance intended to be understood to be the directional component $F_H$ along which the fountain jet 5 primarily spreads in a horizontal projection. In the example shown, this is the direction from the rear to the front, that is to say, the direction from the rear side 9 to the front side 8 of the sink 2 or the washstand 1, as depicted by way of example in FIGS. 9 and 10. In alternative embodiments, the water drain 10 is formed in a slot-like manner with a slot longitudinal axis $L_S$ which is oblique relative to the lateral fountain jet main directional component $F_H$, or the water drain 10 is of another conventional shape, for example, circular or oval.

Figure 3:
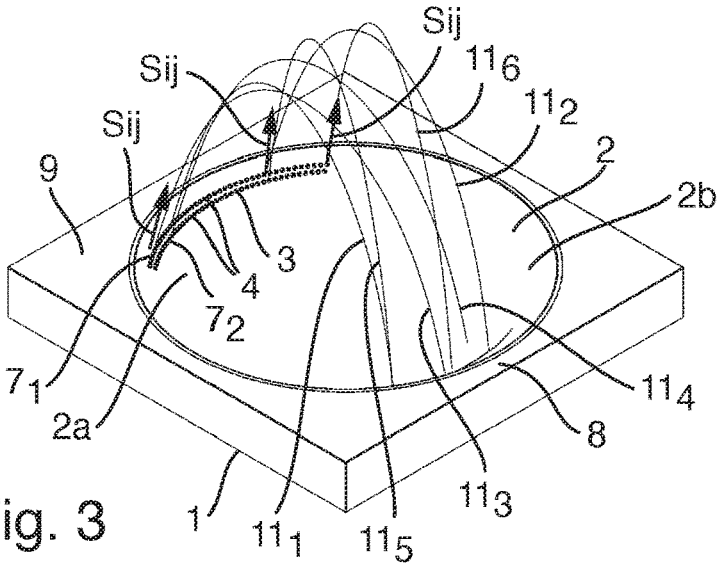
FIG. 3 is the view of FIG. 1, with selected fountain jet individual jets.
Figure 4:
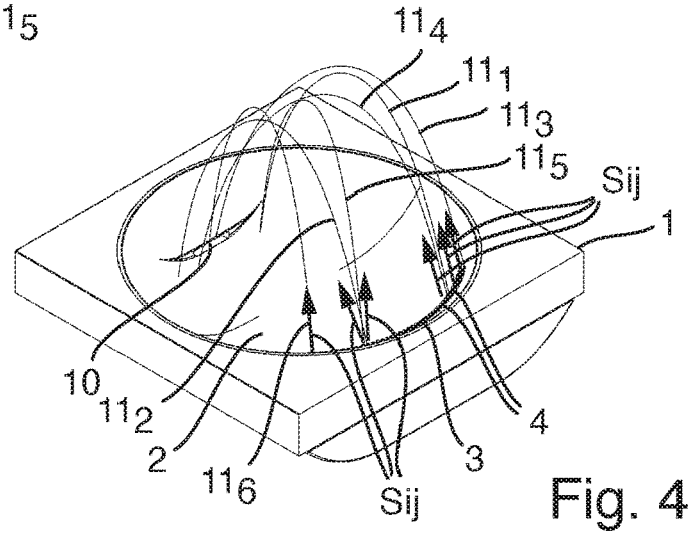
FIG. 4 is a perspective view of the washstand arrangement viewed obliquely from the top rear, with the fountain jet individual jets according to FIG. 3.

Of course, jet outlet directions Sij of the individual jets of the water discharge nozzles 4 generally correspond to the longitudinal axis of the respective water discharge nozzle 4 and have a vertical upward component and a horizontal component which extends forwards and/or perpendicularly and laterally transversely relative thereto. In FIGS. 3 and 4, the jet outlet direction Sij for some individual jets 111 to 116 which are illustrated by way of representation therein is set out. Of course, the selection of the jet outlet directions Sij for the individual jets together with the selection of the water pressure determines the parabolic shape of the fountain jet 5, in particular with regard to the trajectory height and the trajectory width, that is to say, with respect to the maximum height of the fountain jet over the wash-bowl sink 2 and the position of the impingement zone $F_A$ thereof on the sink 2. In advantageous embodiments, the water discharge device 3 is configured to produce the fountain jet 5 with a trajectory height which is between 80% and 120% of the trajectory width, that is to say, the maximum height of the fountain jet at the peak or the upper reversal location thereof is between 80% and 120% of the spacing of the impingement zone $F_A$ from the nozzle assignment region 6. In typical cases, this means a fountain jet height between approximately 20 cm and approximately 40 cm above the sink 2.

In advantageous embodiments, as in the example shown, the water discharge nozzles 4 are arranged in at least two successive nozzle groups $\mathbf{4}_1$, $\mathbf{4}_2$ in the sink circumferential direction, each having a plurality of water discharge nozzles 4. In this instance, a maximum difference of jet outlet directions of the water discharge nozzles 4 of a respective nozzle group, for example, the nozzle group $\mathbf{4}_1$ or the nozzle group $\mathbf{4}_2$, is smaller than a minimum difference of the jet outlet directions of the water discharge nozzles 4 of two adjacent nozzle groups, such as the nozzle groups $\mathbf{4}_1$ and $\mathbf{4}_2$. In other words, when the jet outlet direction of an ith of a number n of water discharge nozzles 4 of a jth nozzle group of a number m of nozzle groups $\mathbf{4}_1, \ldots, \mathbf{4}_m$ is designated $S_{ij}$, wherein the number n of water discharge nozzles 4 may be different for the different nozzle groups $\mathbf{4}_1$, $\mathbf{4}_2$ . . . , the maximum value of the difference $S_{1q}-S_{pq}$, with $1 \leq l \leq n$ and $1 \leq p \leq n$, the jet outlet directions of the water discharge nozzles 4 of each nozzle group $\mathbf{4}_q$ with $1 \leq q \leq m$, is less than a minimum value of the difference $S_{1t}-S_{pq}$ of the jet outlet directions of the water discharge nozzles 4 of two adjacent nozzle groups $\mathbf{4}_t$, $\mathbf{4}_q$, with t=q+1, in an ordered designation of the nozzle groups $\mathbf{4}_1$, $\mathbf{4}_2$, . . . sequential in a sink circumferential direction. It is thereby possible to produce with comparatively little complexity an advantageous jet pattern for the fountain jet 5.

In corresponding embodiments, the water discharge nozzles 4 are, as in the example shown, arranged in three sequential nozzle groups $\mathbf{4}_1$, $\mathbf{4}_2$, $\mathbf{4}_3$, in the sink circumferential direction, wherein the water discharge nozzles 4 of a respective nozzle group have identical lateral jet discharge directional components $S_{Hj}$ and the lateral jet discharge directional components of two lateral nozzle groups $\mathbf{4}_1$, $\mathbf{4}_3$ extend in a manner inclined by a same oblique angle value $W_D$ with respect to the lateral beam discharge directional component of a central nozzle group $\mathbf{4}_2$. The term lateral jet discharge directional component is in this instance intended to be understood to be the component of the beam discharge direction of the respective water discharge nozzle 4 as produced in a horizontal projection and consequently of the individual jet 11 discharged therefrom.

Figure 5:
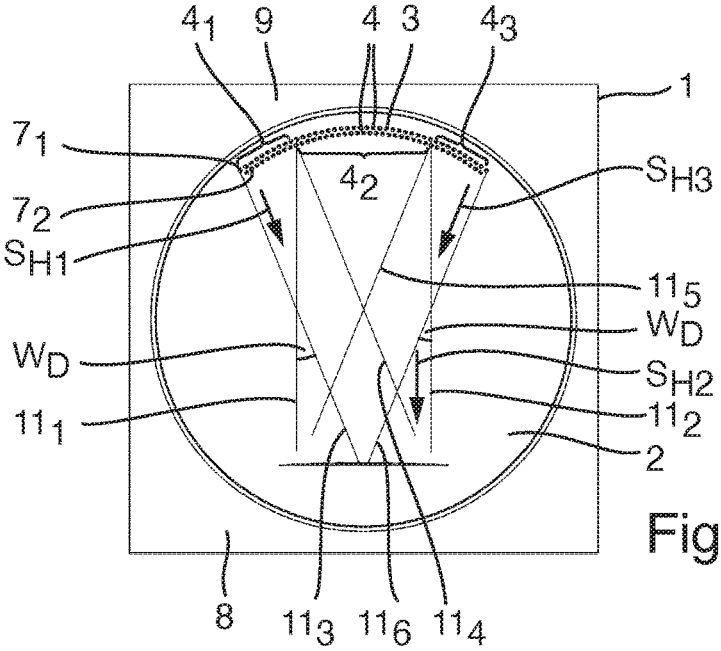
FIG. 5 is the plan view of FIG. 2 with the fountain jet individual jets according to FIG. 3.

In FIGS. 3 to 5, this nozzle grouping and the mentioned relationships with respect to the jet outlet directions of the water discharge nozzles 4 are illustrated by way of example using an exemplary instance and with reference to representative individual jets. The water discharge nozzles 4 of the central nozzle group $\mathbf{4}_2$ emit their individual jets obliquely upwards and in a horizontal projection together with the same lateral jet outlet directional component $S_{H2}$ which extends in this exemplary instance illustrated by way of example precisely from the rear in a forward direction, that is to say, in the direction from the rear side 9 to the front side 8 without any lateral component. Two associated individual jets $\mathbf{11}_1$, $\mathbf{11}_2$ are illustrated at the two end-side water discharge nozzles 4 of the central nozzle group $\mathbf{4}_2$ in FIGS. 3 to 5, in FIG. 5 in addition the associated lateral jet discharge directional component $S_{H2}$. The individual jets of the remaining water discharge nozzles 4 of the central nozzle group $\mathbf{4}_2$ are accordingly located between these two individual edge jets $\mathbf{11}_1$, $\mathbf{11}_2$ of the central nozzle group $\mathbf{4}_2$.

In a similar manner, in FIGS. 3 to 5, two edge-side individual jets $\mathbf{11}_3$, $\mathbf{11}_4$ for one lateral nozzle group $\mathbf{4}_1$ and in a similar manner two edge-side individual jets $\mathbf{11}_5$, $\mathbf{11}_6$ for the other lateral nozzle group $\mathbf{4}_3$ are shown and in FIG. 5 the associated lateral jet discharge directional component $S_{H1}$, $S_{H3}$ is illustrated, wherein it is again a requirement for all the water discharge nozzles 4 within one lateral nozzle group $\mathbf{4}_1$ to have the same beam discharge direction and also all the water discharge nozzles 4 of the other lateral nozzle group $\mathbf{4}_3$ to have the same jet outlet direction relative to each other. FIG. 5 additionally illustrates a said oblique angle value $W_D$, through which the lateral jet discharge directional component $S_{H1}$, $S_{H3}$ of the respective lateral nozzle group $\mathbf{4}_1$, $\mathbf{4}_3$ extends in an inclined manner towards the lateral jet discharge directional component $S_{H2}$ of the central nozzle group $\mathbf{4}_2$.

Figure 6:
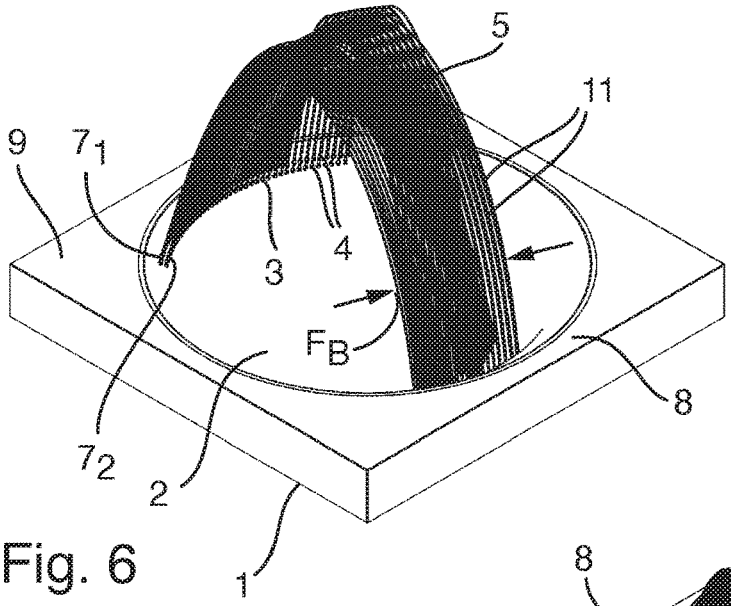
FIG. 6 is the view of FIG. 3 with the activated fountain jet.
Figure 7:
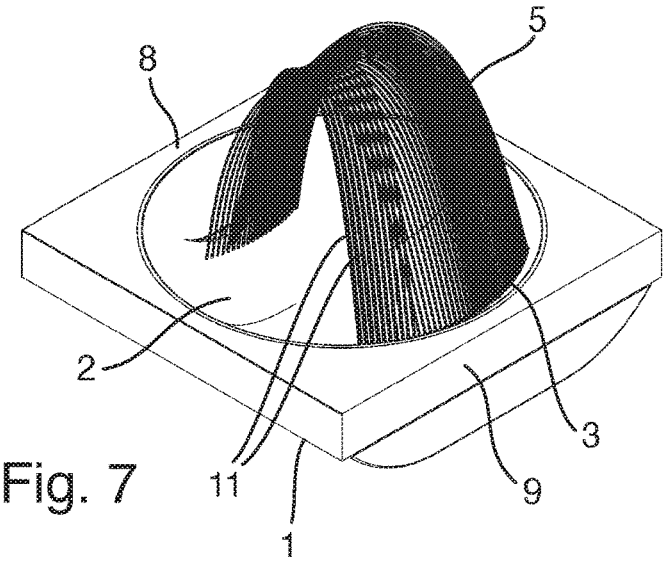
FIG. 7 is the view of FIG. 4 with the activated fountain jet.
Figure 8:
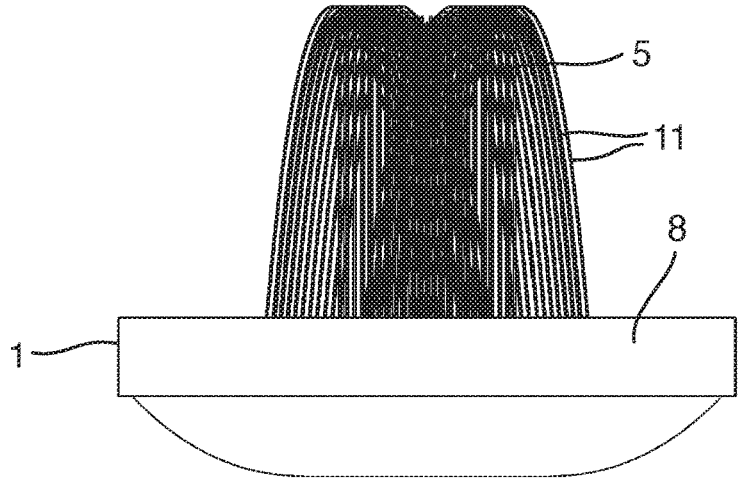
FIG. 8 is a front view of the washstand arrangement with the activated fountain jet.
Figure 9:
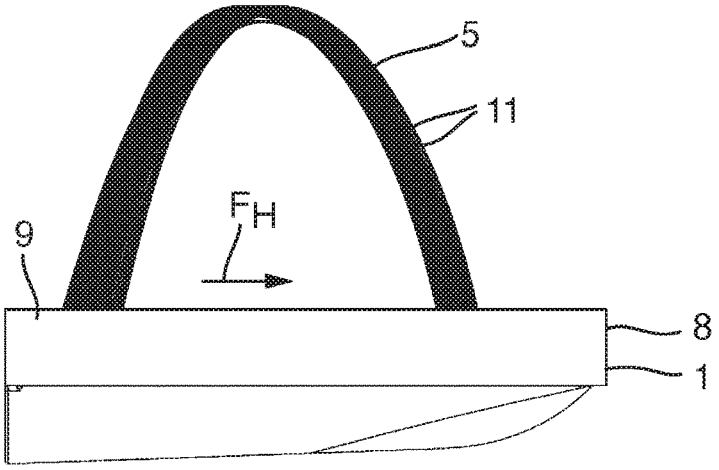
FIG. 9 is a side view of the washstand arrangement with the activated fountain jet.
Figure 10:
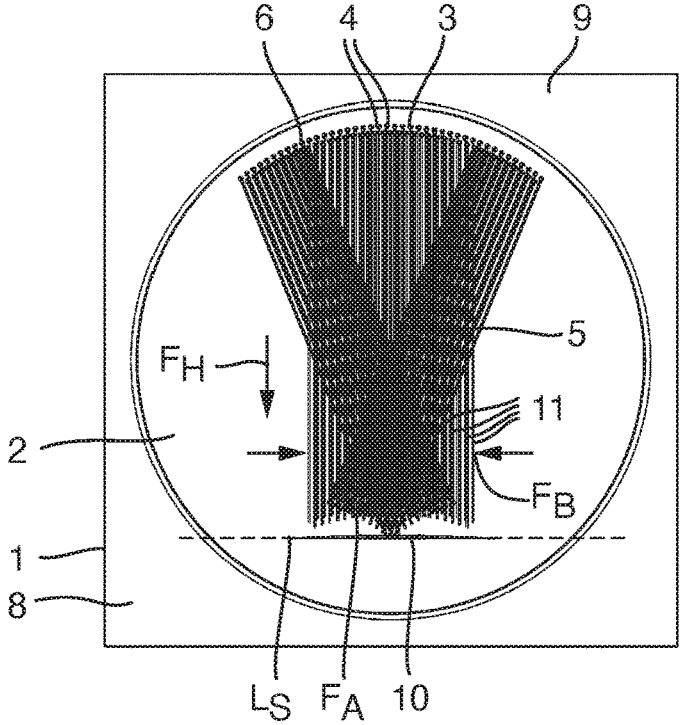
FIG. 10 is the view of FIG. 5 with the activated fountain jet.

There is thereby produced for the resulting fountain jet 5 a convergent jet behaviour of the individual jets or a path of the fountain jet 5 which starting from the water discharge device 3 converges as far as an approximately central region of the wash-bowl sink 2, wherein the fountain jet 5 in this region also reaches its maximum height. The fountain jet 5 subsequently maintains a jet bundle shape and/or a substantially constant jet width $F_B$ up to reaching the impingement zone $F_A$ thereof on the sink 2, as illustrated in FIGS. 6 and 10.

Since, in this illustrative example, the jet outlet directions Sij of all the water discharge nozzles 4 of a respective nozzle group are identical, consequently, the maximum difference of the jet outlet directions Sij of the water discharge nozzles 4 of a respective nozzle group $\mathbf{4}_1$, $\mathbf{4}_2$, $\mathbf{4}_3$ is equal to zero. This is because this difference is equal to zero for the first nozzle group $\mathbf{4}_1$ as well as the second nozzle group $\mathbf{4}_2$ and the third nozzle group $\mathbf{4}_3$ in each case so that the maximum difference when all the nozzle groups $\mathbf{4}_1$ to $\mathbf{4}_3$ are taken into consideration is also equal to zero. However, the jet outlet directions Sij of the water discharge nozzles 4 of the two adjacent nozzle groups $\mathbf{4}_1$ and $\mathbf{4}_2$ in a horizontal projection differ from each other by the oblique angle value $W_D$ and the jet outlet directions Sij of the water discharge nozzles 4 of the two adjacent nozzle groups $\mathbf{4}_2$ and $\mathbf{4}_3$ also differ by the same oblique angle value $W_D$ in the selected illustrative example so that the minimum difference in a horizontal projection is also equal to the oblique angle value $W_D$ and consequently greater than zero and consequently greater than the maximum difference of the jet outlet directions Sij of the water discharge nozzles 4 of each nozzle group $\mathbf{4}_1$ to $\mathbf{4}_3$ from each other.

As can be seen with reference to FIGS. 6 to 10, this arrangement of the water discharge nozzles 4 results in a strip-like or fan-like path/jet pattern of the fountain jet 5 with a central jet strip which is curved in a fountain-like, parabolic trajectory-like manner and which is emitted by the central nozzle group $4_2$, and two lateral jet strips which are inclined so as to converge towards each other and which have with respect to the central jet strip a practically identical trajectory height and trajectory width of their parabolic trajectory-like curved shape, and which are thereby connected to the central strip in order to form the fountain jet 5 as a homogeneous overall jet.

In alternative embodiments, the water discharge nozzles 4 are arranged in at least one of the three nozzle groups $4_1$, $4_2$, $4_3$ with two or more different jet outlet directions instead of all with the same jet outlet direction, for example, the water discharge nozzles of at least one of the nozzle groups $4_1$, $4_2$, $4_3$ so that, as a jet strip emitted from this nozzle group $4_1$ and/or $4_2$ and/or $4_3$, a slightly convergent or slightly divergent jet is produced instead of a jet with a consistent width. In other alternative embodiments, the water discharge nozzles 4 are arranged in more than three sequential nozzle groups in a sink circumferential direction with a jet outlet direction which is mutually identical or in any case less different compared with nozzles of another group.

Figure 11:
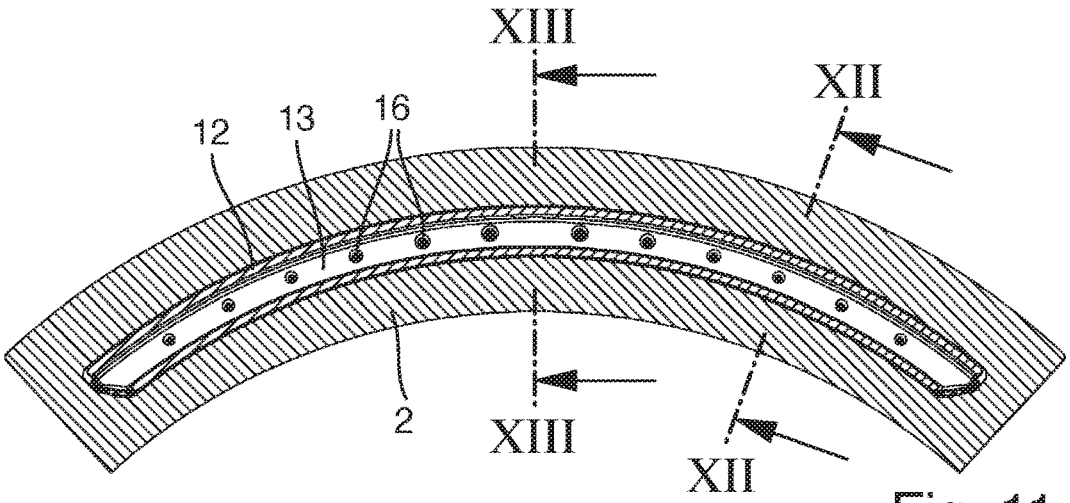
FIG. 11 is a longitudinal sectional view along a line XI-XI in FIG. 13.
Figure 12:
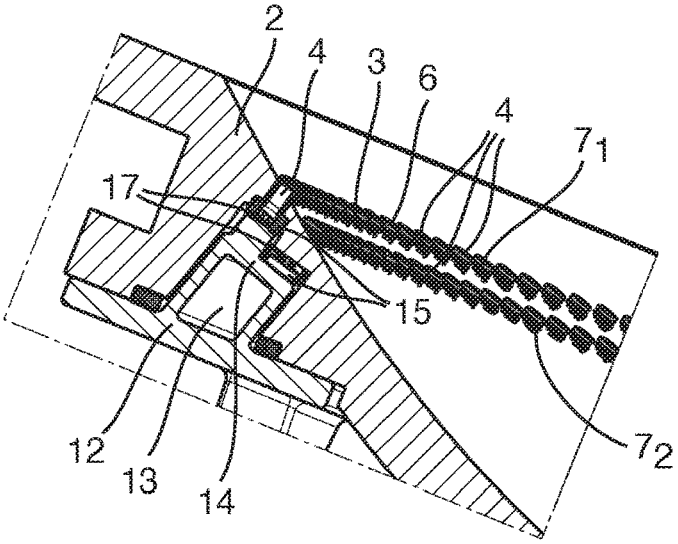
FIG. 12 is a cross-sectional view along a line XII-XII in FIG. 11.
Figure 13:
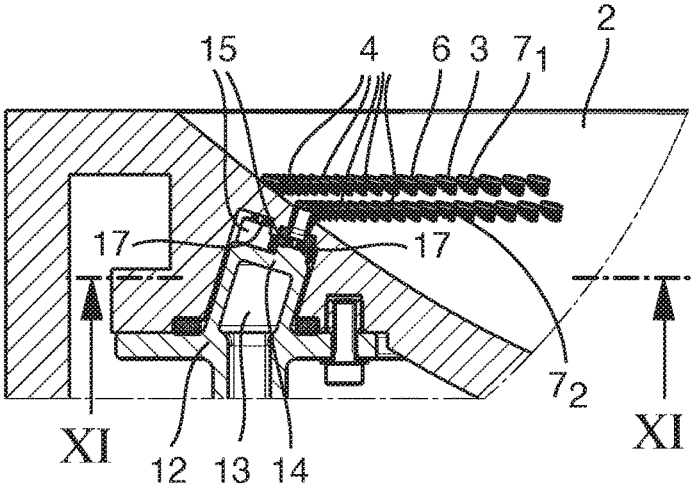
FIG. 13 is a cross-sectional view along a line XIII-XIII in FIG. 11.

For the water supply to the water discharge device, the washstand arrangement has in corresponding advantageous embodiments, as in the example shown, a water distribution member 12 at a lower side of the wash-bowl sink 2 in the nozzle assignment region 6. FIGS. 11 to 13 illustrate an advantageous embodiment of the water distribution member 12 in which it has a water supply chamber 13 which extends over the length of the nozzle assignment region 6 and a water distribution chamber 15 which is separated from the water supply chamber 13 by means of a partition wall 14. The water distribution chamber 15 is located in the position for use of the water distribution chamber 12 vertically above the water supply chamber 13 and is in fluid communication with the water supply chamber 13 via a plurality of passage openings 16 in the partition wall 14. The water discharge nozzles 4 are coupled to the water distribution chamber 15, wherein the water discharge nozzles 4 are in fluid communication with the water distribution chamber 15 via lateral inlet openings 17.

In advantageous embodiments, the water distribution member 12 is produced as an integral component, on which the water discharge nozzles 4 are mounted, for example, as individual nozzle elements, such as PowderRain nozzle elements. The passage openings 16 are provided with preferably substantially uniform spacing from each other in the partition wall 14, for example, as holes which are located beside each other in a row and which are spaced apart from each other. The water distribution member 12 advantageously corresponds in terms of its longitudinal extent to that of the nozzle assignment region 6 so that it extends in the example shown in accordance with the nozzle assignment region 6 in a curved manner and the longitudinal extent thereof substantially corresponds to the strip length $D_L$ of the nozzle assignment region 6. In order to activate and deactivate the water supply to the water distribution member, any conventional means which are known per se to the person skilled in the art can be used, which in this regard consequently requires no further explanation, for example, using mechanically or electrically controllable shut-off valves, which are arranged in a water supply line to the water distribution member.

As the exemplary embodiments shown and the additional ones explained above make clear, the invention provides a washstand arrangement with significant advantages for the user. The water is provided as a fountain jet via water discharge nozzles which are arranged in the wash-bowl sink. A conventional sanitary outlet fitting with an outlet pipe which terminates over the sink can thereby be dispensed with. This has advantages for the usability of the washstand arrangement since an outlet pipe of an outlet fitting does not have to be taken into account. In addition, the washstand can be configured on the whole with a very planar surface, which can significantly facilitate the cleaning of the washstand arrangement. The omission of an outlet fitting which is typically mounted on the washstand in the region of the wash-bowl sink with an outlet pipe which terminates over the sink also facilitates the cleaning of the washstand arrangement.

Although the invention has been described in detailed with reference to preferred embodiments, variations and modifications exist within the spirit and scope of the invention as described and defined in the following claims.

The invention claimed is:

1. A washstand arrangement comprising:

a washstand having a wash-bowl sink, and a water discharge device, configured for discharging water in the form of a fountain jet composed of individual jets and comprising a plurality of water discharge nozzles which are arranged in the wash-bowl sink for discharging the individual jets in associated individual jet directions issued from the wash-bowl sink obliquely upwards and back again to the wash-bowl sink, wherein the water discharge nozzles are arranged within a strip-type nozzle assignment region having a strip length extending in sink circumferential direction and a strip height perpendicular thereto, wherein its strip length is greater than its strip width, and wherein its strip length extends at most across half the sink circumference, wherein the nozzle assignment region is located in a rear-side half of the wash-bowl sink facing away from a user side, and wherein the wash-bowl sink has a water drain in a front side half facing towards the user side, wherein a fountain jet impingement zone of the wash-bowl sink is located on a side of the water drain facing towards the nozzle assignment region.

2. The washstand arrangement according to claim 1, wherein the strip-type nozzle assignment region extends with its strip length across at most one quarter of the sink circumference.

3. The washstand arrangement according to claim 1, wherein the water discharge nozzles within the nozzle assignment region are arranged in at least two nozzle rows, wherein the water discharge nozzles of a respective nozzle row are arranged in the sink circumferential direction offset in relation to the water discharge nozzles of a respective adjacent nozzle row.

4. The washstand arrangement according to claim 1, wherein the water drain is slot-shaped having a slot longitudinal axis perpendicular to a lateral fountain jet main directional component.

5. The washstand arrangement according to claim 1, further comprising a water distributor body on a bottom side of the wash-bowl sink in the nozzle assignment region, wherein the water distributor body comprises a water supply chamber extending over the length of the nozzle assignment region, and a water distribution chamber separated from the water supply chamber by a partition wall and connected in fluid communication to the water supply chamber via a plurality of passage openings in the partition wall, the water discharge nozzles being coupled to the water distributor body and being in fluid communication with the water distribution chamber via lateral inlet openings.

6. The washstand arrangement according to claim 1, wherein the wash-bowl sink is circular in shape.

7. The washstand arrangement according to claim 1, wherein the water discharge nozzles are arranged in at least two successive nozzle groups in the sink circumferential direction, each group including multiple water discharge nozzles, wherein a maximum difference of jet outlet directions of the water discharge nozzles of a respective nozzle group is less than a minimum difference of the jet outlet directions of the water discharge nozzles of in each case two adjacent nozzle groups.

8. The washstand arrangement according to claim 7, wherein the water discharge nozzles are arranged in three successive nozzle groups in the sink circumferential direction, wherein the water discharge nozzles of a respective nozzle group have equal lateral jet outlet directional components and the lateral jet outlet directional components of two side-positioned nozzle groups extend inclined towards the lateral jet outlet directional component of a central nozzle group by a same oblique angle value.

9. A washstand arrangement, comprising:

a washstand having a wash-bowl sink, and a water discharge device, configured for discharging water in the form of a fountain jet composed of individual jets and comprising a plurality of water discharge nozzles which are arranged in the wash-bowl sink for discharging the individual jets in associated individual jet directions issued from the wash-bowl sink obliquely upwards and back again to the wash-bowl sink, wherein the water discharge nozzles are arranged within a strip-type nozzle assignment region having a strip length extending in sink circumferential direction and a strip height perpendicular thereto, wherein its strip length is greater than its strip width, and wherein its strip length extends at most across half the sink circumference, and wherein the water discharge nozzles are arranged in at least two successive nozzle groups in the sink circumferential direction, each group including multiple water discharge nozzles, wherein a maximum difference of jet outlet directions of the water discharge nozzles of a respective nozzle group is less than a minimum difference of the jet outlet directions of the water discharge nozzles of in each case two adjacent nozzle groups.

10. The washstand arrangement according to claim 9, wherein the nozzle assignment region is located in a rear-side half of the wash-bowl sink facing away from a user side.

11. The washstand arrangement according to claim 9, wherein the water discharge nozzles are arranged in three successive nozzle groups in the sink circumferential direction, wherein the water discharge nozzles of a respective nozzle group have equal lateral jet outlet directional components and the lateral jet outlet directional components of two side-positioned nozzle groups extend inclined towards the lateral jet outlet directional component of a central nozzle group by a same oblique angle value.

12. The washstand arrangement according to claim 9, wherein the strip-type nozzle assignment region extends with its strip length across at most one quarter of the sink circumference.

13. The washstand arrangement according to claim 9, wherein the water discharge nozzles within the nozzle assignment region are arranged in at least two nozzle rows, wherein the water discharge nozzles of a respective nozzle row are arranged in the sink circumferential direction offset in relation to the water discharge nozzles of a respective adjacent nozzle row.

14. The washstand arrangement according to claim 9, wherein the water drain is slot-shaped having a slot longitudinal axis perpendicular to a lateral fountain jet main directional component.

15. The washstand arrangement according to claim 9, further comprising a water distributor body on a bottom side of the wash-bowl sink in the nozzle assignment region, wherein the water distributor body comprises a water supply chamber extending over the length of the nozzle assignment region, and a water distribution chamber separated from the water supply chamber by a partition wall and connected in fluid communication to the water supply chamber via a plurality of passage openings in the partition wall, the water discharge nozzles being coupled to the water distributor body and being in fluid communication with the water distribution chamber via lateral inlet openings.

16. The washstand arrangement according to claim 9, wherein the wash-bowl sink is circular in shape.

* * * * *